US005560155A

United States Patent [19]

Back

[11] Patent Number: 5,560,155

[45] Date of Patent: Oct. 1, 1996

[54] MODULAR SOLARIUM

[76] Inventor: Mark A. Back, 119 Lloyd's Rd., Winchester, Va. 22602

[21] Appl. No.: 257,736

[22] Filed: Jun. 9, 1994

[51] Int. Cl.[6] ..... E04B 1/343

[52] U.S. Cl. ..... 52/90.1; 52/204.7; 52/762; 52/772

[58] Field of Search ..... 52/82, 90.1, 93.1, 52/204.597, 204.7, 204.705, 235, 309.16, 461, 469, 262, 783.1, 786.1, 786.11, 788.1, 800.1, 800.11, 800.14, 762, 772, 780; 49/DIG. 2

[56] References Cited

U.S. PATENT DOCUMENTS

| | | | |
|---|---|---|---|
| 2,947,040 | 8/1960 | Schultz . | |
| 3,055,461 | 9/1962 | DeRidder . | |
| 3,562,992 | 2/1971 | Kinsey . | |
| 3,733,756 | 5/1973 | Butler . | |
| 3,760,544 | 9/1973 | Hawes et al. | 52/309.16 X |
| 3,805,470 | 4/1974 | Brown | 52/204.597 |
| 3,952,461 | 4/1976 | Kinsey . | |
| 3,978,629 | 9/1976 | Echols, Sr. | 52/235 |
| 4,057,941 | 11/1977 | Schwartz | 52/93.1 X |
| 4,583,333 | 4/1986 | Minter | 52/262 X |
| 4,601,139 | 7/1986 | Esposito | 52/93.1 |
| 4,765,102 | 8/1988 | Kuchem | 52/90.1 X |
| 4,796,395 | 1/1989 | Israel . | |
| 5,090,164 | 2/1992 | Mische | 52/90.1 |
| 5,125,207 | 6/1992 | Strobl . | |
| 5,325,647 | 7/1994 | Forry et al. | 52/309.16 X |
| 5,363,615 | 11/1994 | Christopher et al. | 52/204.597 X |
| 5,394,664 | 3/1995 | Nowell | 52/90.1 X |

FOREIGN PATENT DOCUMENTS

| | | | |
|---|---|---|---|
| 2141165 | 12/1984 | United Kingdom | 52/204.7 |

*Primary Examiner*—Wynn E. Wood
*Assistant Examiner*—Kevin D. Wilkens
*Attorney, Agent, or Firm*—Richard M. Goldberg

[57] ABSTRACT

A modular construction for solariums and like structures, provides prefabricated glazed panels and interlocking joint assemblies which are easily assembled in the field without need for tools or other equipment. The panels are used for the construction of walls and ceilings, and are formed of a transparent sheet (preferably double pane glass, for its superior thermal efficiency) with a peripheral frame. The frame and joint material is preferably ultra high density polyvinyl chloride plastic material, although other materials may be used. A steel plate may be installed within the joints for additional structural strength. The construction places the transparent panels substantially adjacent the outer edges of the frame members and joints to reduce the likelihood of protruding panel edges serving as traps for water and/or debris. Preferably, the frame members are formed as hollow extrusions with plural longitudinal cavities therein, both to reduce weight and also to provide conduits for electrical wiring and/or plumbing, if desired.

40 Claims, 3 Drawing Sheets

MODULAR SOLARIUM

FIELD OF THE INVENTION

The present invention relates generally to prefabricated structural panels and the like, and more specifically to double pane, insulated glass panels which have been preassembled with interlocking frame and joint assemblies for ease of assembly in the field. At least the ceiling panels each include continuous expanses of glass thereacross, with no intervening structural members. While some panels may include braces, muntins or the like, such structural members reside on the inner surface of the double paned glass panels to provide structural support therefor.

BACKGROUND OF THE INVENTION

In consideration of new housing prices, many households are constructing additions or otherwise remodeling their existing homes to add features which were unavailable or unaffordable at purchase, rather than purchasing newer homes. One feature which has become increasingly popular is the solarium or sunroom, an extension formed primarily of transparent panels for walls and ceiling.

In many cases, the owner(s) of the home or property prefers to perform the work himself/themselves, rather than incurring the expense of hiring a professional to do the work. While this may be feasible in the case of standard construction, specialized work such as glazing large panels for a solarium is generally beyond the average handyman. Thus, when labor costs are added to the cost of the materials, quite often such a solarium addition or the like is beyond the budget of the home or property owner.

Accordingly, the need arises for prefabricated glazed panels available for purchase by the home or property owner, which glazed panels provide for ease of assembly by means of interlocking construction. Such panels include a glass or other transparent sheet extending substantially across the entire dimensions of the panel, with a peripheral frame and joints providing for the interlocking of the panels for ease of assembly. Preferably, the transparent panels are double or triple paned glass for optimum thermal efficiency. At least the roof/ceiling panels should have no externally exposed muntins or other structural members, thereby precluding the trapping of moisture and debris in such areas.

DESCRIPTION OF THE PRIOR ART

U.S. Pat. No. 2,947,040 issued to David Schultz on Aug. 2, 1960 discloses a Wall Construction essentially using a tongue and groove assembly means. The tongues are split and include a resilient member therein, urging the two halves of the split tongue apart to wedge the tongue firmly into the cooperating groove. No transparent panels are disclosed, and the interlocking means is unlike that used in the present invention. Moreover, no prefabrication of the panels is disclosed.

U.S. Pat. No. 3,055,461 issued to Ernst J. DeRidder on Sep. 23, 1962 discloses Interlocking Metallic Structural Members which may be used in building construction. No means of using the opaque metal panels as frames for transparent panels is disclosed, and a separate step (riveting, welding, dimpling) must be used to lock the panels together to preclude their shifting relative to one another due to shear, unlike the present invention.

U.S. Pat. No. 3,562,992 issued to Lewis R. Kinsey on Feb. 16, 1971 discloses a Building Structural Element comprising a plurality of substantially rectangular elements with interlocking means thereon. Again, no means is disclosed for adapting the elements as frame members for transparent panels, as in the present invention.

U.S. Pat. No. 3,733,756 issued to David R. Butler on May 22, 1973 discloses a Modular Partition System comprising a plurality of interlocking opaque panels. The panels must be assembled back-to-back and overlapping, unlike the single panels of the present invention. The panels are essentially monolithic, and thus no means is disclosed for the addition of central areas of transparent sheet, as in the present invention.

U.S. Pat. No. 3,952,461 issued to Lewis R. Kinsey on Apr. 27, 1976 discloses Multi-Layer Walls For Frameless Buildings Formed From Extruded Aluminum Or Plastic Interlocking Wall Elements. A multitude of differently shaped elements is disclosed, roughly equivalent to studs, plates, flooring, rafters, joists, purlins, and sheathing of conventional construction. The interlocking means is substantially similar to that disclosed in the Kinsey '992 patent discussed above. Once again, no means is disclosed for the provision of prefabricated glazed panels within frames which can be easily interlockingly assembled with other like building elements, as in the present invention.

U.S. Pat. No. 4,796,395 issued to Benjamin Israel on Jan. 10, 1989 discloses a Solarium With Muntinless Exterior and utilizing double paned glass panels therein. The assembly is held together with separate threaded fasteners, unlike the interlocking assembly of the present invention.

Finally, U.S. Pat. No. 5,125,207 issued to Frederick P. Strobl, Jr. et al. on Jun. 30, 1992 discloses a Method For Assembling A Space Enclosure Structure comprising a plurality of frame members with channels for the insertion of other (opaque or transparent) panels therein. The frame members must be bolted together, unlike the present construction, and the frame members must be flexed apart to allow the insertion of the panels into the channels thereof. The present invention provides prefabricated panels comprising transparent portions including peripheral frame members, ready for interlocking assembly in the field.

None of the above noted patents, taken either singly or in combination, are seen to disclose the specific arrangement of concepts disclosed by the present invention.

SUMMARY OF THE INVENTION

By the present invention, an improved modular solarium construction is disclosed.

Accordingly, one of the objects of the present invention is to provide an improved modular solarium construction which makes use of prefabricated panels comprising transparent sheet material over the substantial majority of the panel, surrounded by a peripheral frame and joint providing for interlocking with other like panels.

Another of the objects of the present invention is to provide an improved modular solarium construction which requires no tools or separate fasteners for assembly, but includes cooperating fastening components formed in the frame and joint members.

Yet another of the objects of the present invention is to provide an improved modular solarium construction in which peripheral frame members are formed of ultra high density polyvinyl chloride.

Still another of the objects of the present invention is to provide an improved modular solarium in which transparent panels are formed of at least one sheet, and preferably two sheets, of glass.

A further object of the present invention is to provide an improved modular solarium construction which includes structural steel reinforcement and interior concealment thereof, in at least the ceiling portions of the joint members.

An additional object of the present invention is to provide an improved modular solarium construction in which peripheral frame members include internal passages therein, for the reduction of weight and for the passage of electrical, plumbing, and/or other elements therethrough.

Another object of the present invention is to provide an improved modular solarium construction which includes insulation means between the adjacent frame members.

Yet another object of the present invention is to provide an improved modular solarium construction which includes unbroken expanses of transparent material between the peripheral frame members, with lateral muntins installed beneath the transparent sheets in at least the ceiling or roof panels.

A final object of the present invention is to provide an improved modular solarium construction for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 2:
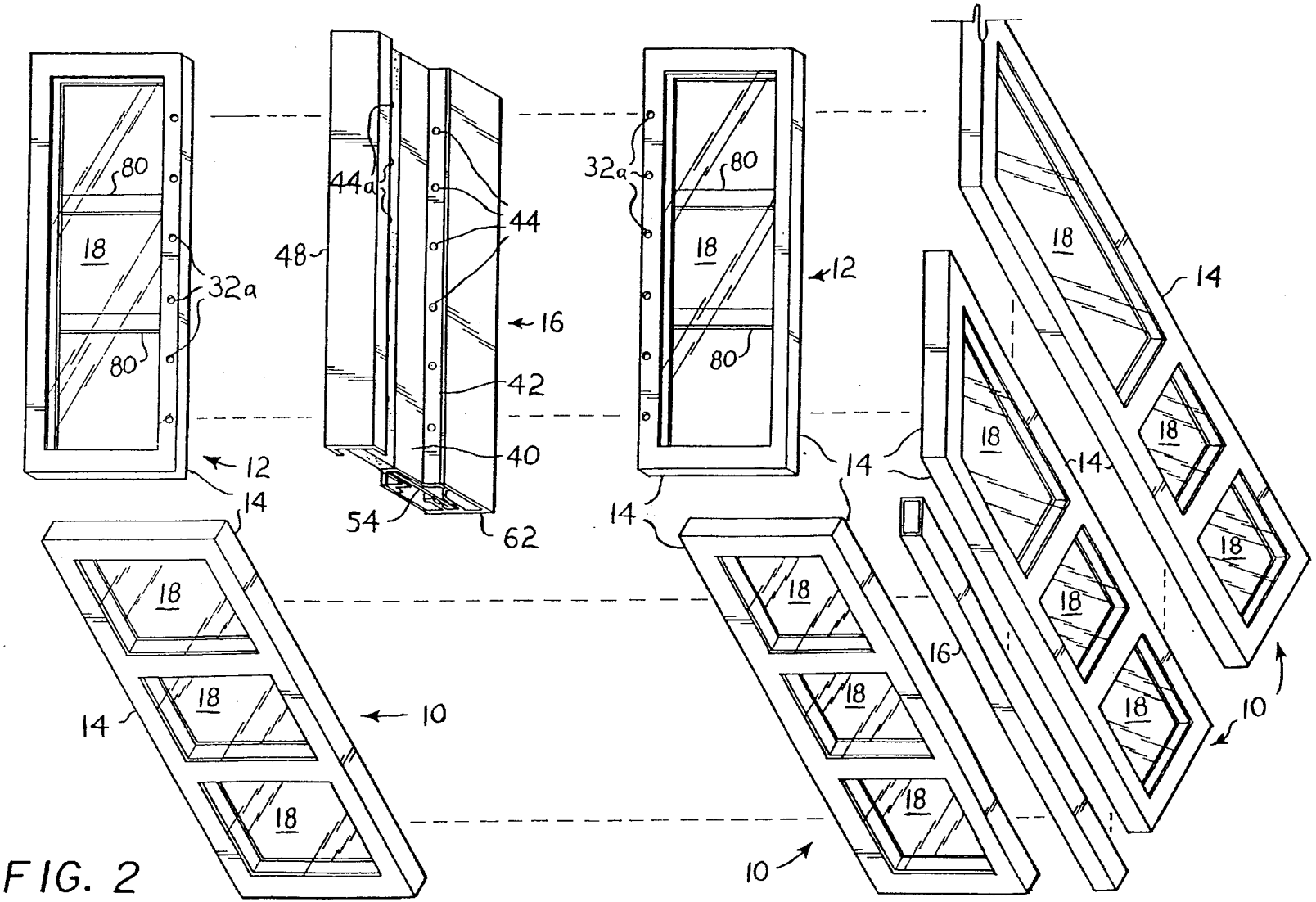
FIG. 2 is an exploded view of an assembly of panels of the present invention, showing their relative positions for assembly.

Referring now particularly to FIG. 2 of the drawings, the present invention will be seen to relate to a modular solarium construction comprising a plurality of wall panels 10 and ceiling panels 12, with the panels 10 and 12 including cooperating means along their peripheral frames 14 for interlocking installation with a plurality of joints 16 to form the completed structure. The panels 10 and 12 include transparent sheets of material 18 across the substantial majority of their areas, with the frames 14 being formed of an opaque material and installed at the time of manufacture to provide for the interlocking assembly of the panels 10 and 12 with the cooperating joints 16 in the field. While the wall panels 10 are shown as having plural transparent sheets 18 therein, it will be understood that each of the transparent sheets 18 of the wall panels 10 may include its own peripheral frame 14, and may be assembled to other wall panels 10 using joints 16, in the manner to be described further below.

Figure 1:
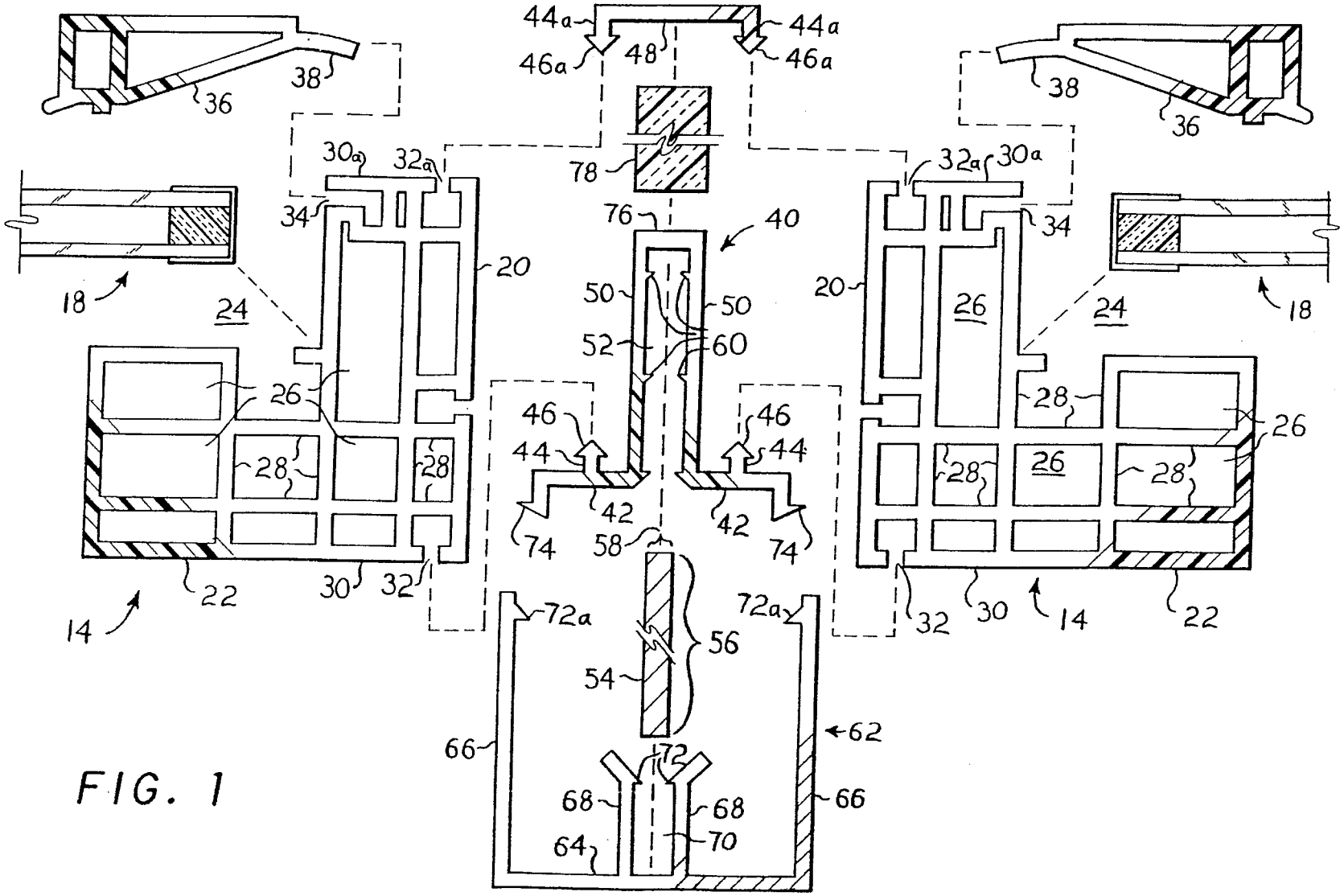
FIG. 1 is an exploded view in section of the components of the present invention, particularly showing details of the peripheral frame and joint members and their mutual securing means.

FIG. 1 discloses an exploded detailed view of the frame 14 and joint 16 configurations and assembly. Frames 14 and joints 16 are preferably formed of a plastic material for corrosion resistance, light weight, ease of extrusion, and other desirable properties; ultra high density polyvinyl chloride (UPVC) plastic material has been found to be satisfactory for the construction of the frames 14 and joints 16 of the present invention. The peripheral frame components 14 are preferably extruded or otherwise formed in the general shape of an "L," with a first leg 20 and a second leg 22 at right angles to the first leg 20. The resulting space 24 between the two legs 20 and 22 provides a seat for the transparent panels 18. Preferably, the frames 14 are not formed as a solid section, but are formed with a plurality of longitudinal passages 26 therein, with internal webs 28 separating the passages. Such construction provides exceptional strength, while still providing relatively light weight. The outer walls 30 of the frame members 14 include a series of holes or passages **32/32*a* formed therein, which holes provide for the field assembly of the joints 16 with the frames 14** to form a solarium of modular construction.

The frames 14 further include a slot 34 adjacent the upper end of the first leg 20, which slot 34 cooperates with a peripheral retainer 36 to permanently secure the transparent sheet 18 within the seat 24 of the frame 14. Each retainer 36 is of generally triangular cross section, with an extension 38 formed along one apex thereof. The extension is formed with a concave curvature along its inner side, which when inserted into the slot 34, causes the retainer 36 to be biased against the transparent sheet 18 to sandwich the sheet 18 between the second leg 22 of the frame member 14 and the retainer 36.

The transparent sheet 18, along with the retainer 36, are preferably installed within the frame sections 14 using a relatively weatherproof and moistureproof sealant; a silicone sealant has been found to work well for such an application. The transparent sheets 18 are permanently assembled within the frames 14, with the retainers 36 being permanently installed thereover, at the time of manufacture of the panels 10 and 12.

While one or more sheets of transparent material may be used for the transparent panels 18 of the present invention, preferably glass is used for its weather resistance, durability, and resistance to discoloring due to the effects of ultraviolet and other sunlight. Preferably, double (or even triple) sheet panels 18 are used, for optimum thermal efficiency.

Figure 3:
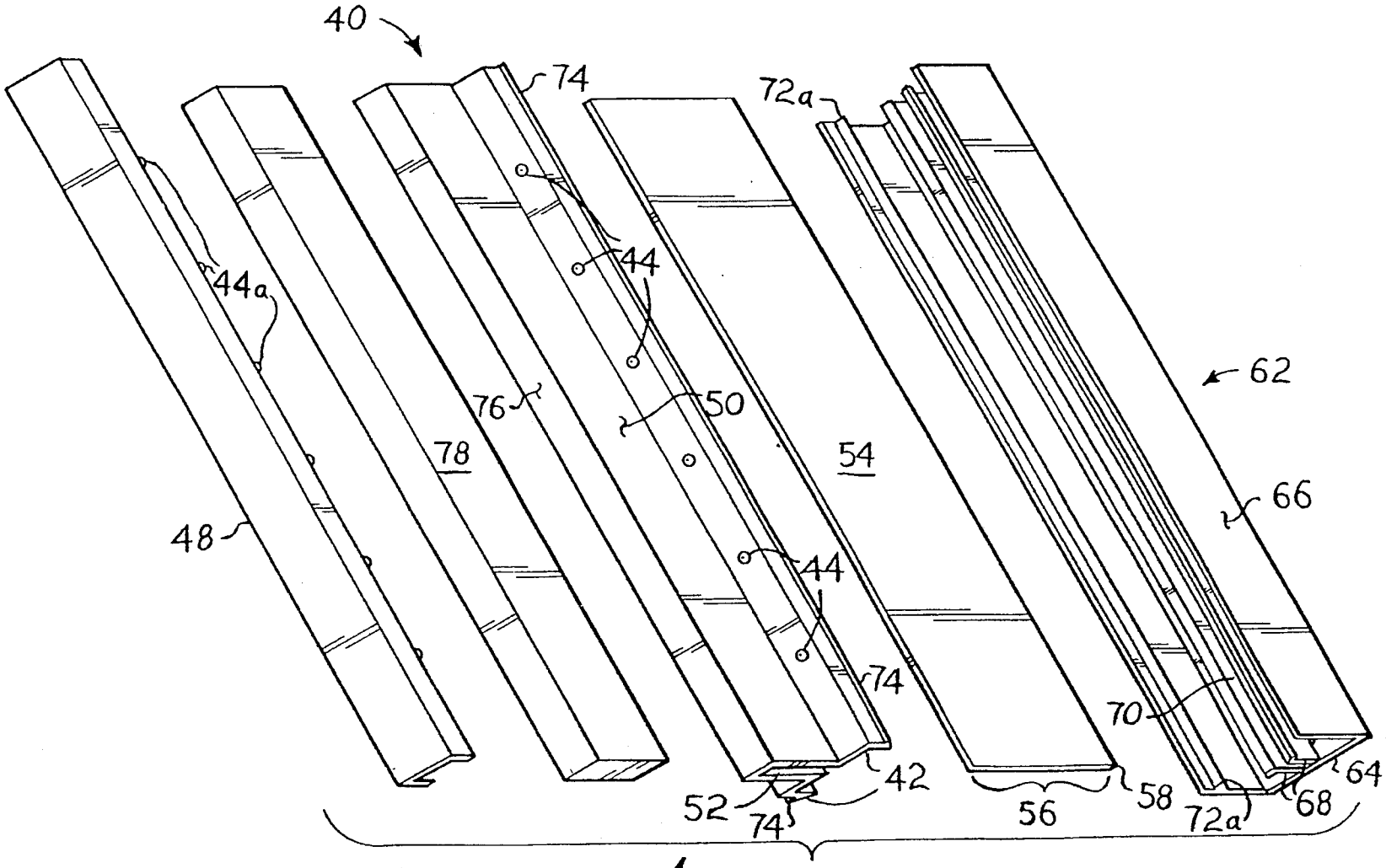
FIG. 3 is an exploded view of one of the joint members of the present invention, showing its order of assembly.

FIG. 3 discloses an exploded view of a joint assembly 16 of the present invention, used in the field assembly of the panels 10 and 12. The primary component of the joint assembly 16 is the central frame connecting member 40 which includes two opposed flanges 42, which flanges 42 each include a plurality of protrusions 44 having flanged tips 46 thereon (see FIG. 1). The flanged tips 46 of the protrusions 44 are larger than the holes 32 in the outer walls 30 of the frame members 14, but due to the resilient nature of the plastic materials of which the frame members 14 and the joint assembly 16 are made, the flanged tips may be distorted sufficiently to pass through the holes 32 and be captured within the internal frame passages 32, thereby providing a rapid and easy permanent assembly of the frames 14 (and their included transparent panels 18) and the central connecting members 40 of the joints 16. FIG. 1 provides a view of the above assembly details, as well as those following.

The flanges 42 and their protrusions 44 connect the lower or interior surfaces of the peripheral frames together. A further connecting means between the opposite sides 30*a* of the frame members 14 is provided by an outer connecting joint cap 48 which spans the two adjacent frame members 14 of adjacent panels 10 or 12. The cap 48 includes a series of protrusions 44*a* with flanged tips 46*a* extending therefrom, in the manner of the protrusions 44 and flanked tips 46 of the central frame connecting member 40 discussed above. The protrusions 44*a* with their flanged tips 46*a* interlock with the holes 32*a* in the upper surface 30*a* of the frame members 14 to further provide for the assembly of the panels 10 and 12 with the connecting joints 16.

The above discussed field assembly will result in a structure which is adequately sturdy under most conditions. However, in the event that additional strength and/or stiffness is required, e.g., for panel spans of several feet or more, additional strength may be provided. The central frame connecting member 40 includes two opposite, spaced apart walls 50 from which the flanges 42 extend, with the two walls 50 defining a channel 52 therebetween. The channel 52 provides room for the installation of a longitudinally reinforcing steel plate 54, or other suitable component, therein. The plate 54 has a width 56 considerably greater than its thickness 58, which width 56 may extend somewhat beyond the depth of the channel 52 of the central connecting member 40. The thickness 58 closely cooperates with the width of the channel 52, and is retained therein by a plurality of inwardly facing teeth 60, which grip the face of the plate 54. By orienting the plate 54 so its width 56 is oriented perpendicularly to the plane of the panels 10 and 12, considerably greater bending strength for the panels is provided.

As the above described plate 54 may extend somewhat beyond the mouth of the central connector channel 52, an internal cover 62 may be provided to conceal the inner edge of the plate 54. The cover 62 includes a central member 64 with oppositely spaced apart walls 66 extending therefrom. The central member 64 includes two spaced apart flanges 68 extending inwardly therefrom, with the flanges 68 defining a channel 70 and including inwardly gripping ribs 72 providing for the securing of the cover 62 to the inner edge of the plate 54. Additional inwardly gripping ribs 72*a* are provided on the edges of the cover walls 66, which ribs 72*a* cooperate with outwardly gripping latches 74 extending from the connecting member flanges 42. Thus, when adjacent panels 10 and/or 12 have been connected by means of joints 16, and a plate 54 installed within the channel 52 of the central frame connecting member 40, the cover 62 may be locked into place by means of the interlocking ribs 72*a* and latches 74, as well as the inwardly gripping ribs 72 which engage the sides of the plate 54.

While the preferably double sheet transparent panels 18 and the air spaces provided by the internal passages 26 within the frame members 14 each provide insulating advantages and thermal efficiency for the present construction, it will be noted that the steel reinforcing plate 54 and (preferably) metal internal cover 62 are highly thermally conductive and provide a thermal path from the interior of the solarium structure to the airspace adjacent the exterior joint cap 48. Accordingly, some space is provided for between the interior of the cap 48 and the top wall 76 of the frame connecting member 40, for the installation of insulation 78 therein. The insulation 78 may be of any suitable type, e.g., a synthetic foam plastic or other suitable material.

The above described modular construction will be seen to provide a quickly and easily built solarium or other structure for additions to present structures or other uses. The prefabricated assembly of the transparent panels 18 with the peripheral frame members 14 and peripheral transparent sheet retainers 36 during manufacture, provides for quick and easy assembly of wall and ceiling panels 10 and 12 in the field by means of the joint assemblies 16. The panels 10 and 12 may be manufactured in virtually any size and shape and no special tools or equipment are needed, as the joint assemblies 16 automatically interlock with the frame components 14 to provide a sturdy, completed structure. Further structural strength is provided by steel plates 54 installable within the joint assemblies 16, and additional transverse strength for elongate panels, e.g., ceiling panels 12, may be provided by transverse muntins 80 installed on the inner sides of the frames 14 (FIG. 2) to provide an unbroken expanse of glass or other transparent sheet between the peripheral frame members 14. The use of plastic, e.g., UPVC material, provides for a lightweight yet sturdy frame and joint structure which is highly resistant to weathering and is impervious to corrosion.

It is to be understood that the present invention is not limited to the sole embodiment described above, but encompasses any and all embodiments within the scope of the following claims.

I claim:

1. A modular solarium construction comprising:

a plurality of prefabricated wall panels, prefabricated ceiling panels, and joint members;

each of said prefabricated wall panels and prefabricated ceiling panels comprising at least one transparent sheet of material having a peripheral edge and a peripheral frame supporting said peripheral edge and positioned therearound, with said peripheral frame having at least opposite outer surfaces with an opening in each said outer surface;

each of said joint members including a joint frame member and a plurality of protrusions extending from said joint frame member, with each of said protrusions having a free enlarged end;

said protrusions of said joint members penetrating said openings of said frames with each said enlarged end being captured within a respective said opening;

wherein each said peripheral frame is interlocked with said joint members to form an enclosed solarium structure comprising plural walls and a ceiling formed of said panels interconnected with said joint members.

2. The modular solarium construction of claim 1 wherein:

said at least one transparent sheet of material comprises glass.

3. The modular solarium construction of claim 2 wherein:

said glass comprises a double sheet having a space therebetween and providing for thermal efficiency.

4. The modular solarium construction of claim 1 wherein:

said peripheral frame and said joint members are formed of opaque plastic material.

5. The modular solarium construction of claim 4 wherein:

said plastic material comprises ultra high density polyvinyl chloride.

6. The modular solarium construction of claim 1 wherein:

at least said ceiling panels include a single unbroken expanse of transparent material, with said frame of said ceiling panels including at least one transverse muntin thereacross and disposed entirely beneath said unbroken expanse of transparent material.

7. The modular solarium construction of claim 1 wherein:

said joint members each include a longitudinal reinforcement member at least partially captured therewithin.

8. The modular solarium construction of claim 7, wherein:

said longitudinal reinforcement member comprises a plate having a width and a thickness with said width being a greater dimension than said thickness, and said plate is installed with said width disposed perpendicularly to said panels.

9. The modular solarium construction of claim 7 wherein:

said longitudinal reinforcement member is a steel plate.

10. The modular solarium construction of claim 1 including:

an interior, joint cover disposed over each of said joint members.

11. The modular solarium construction of claim 10 wherein: said interior joint cover is formed of metal.

12. The modular solarium construction of claim 1 wherein:

each of said frame members includes a plurality of longitudinal cavities therewithin.

13. A modular solarium construction comprising a plurality of prefabricated wall panels, ceiling panels, and joint members;

said panels each comprising at least one transparent sheet of material having a peripheral edge and a peripheral frame thereabout, with said peripheral frame including means providing for the interlocking assembly of said frame with said joint members;

each of said frame members has a cross sectional shape comprising a first leg and a second leg at right angles to said first leg, with said first leg and said second leg defining a seat therebetween for said transparent panel;

each of said frame members further having a plurality of rectangular longitudinal passages therethrough, and;

said transparent panel is permanently assembled within said seat of said each of said frame members by a peripheral retainer interlockingly installed with said each of said frame members and overlying said peripheral edge of said transparent panel to capture said peripheral edge of said transparent panel within said seat of said each of said frame members;

said peripheral retainer has a substantially triangular cross sectional shape, with one apex of said triangular cross sectional shape including an extension therealong, with said extension having an inwardly concave curvature thereto, and;

said each of said frame members includes a longitudinal slot formed along said first leg thereof, with said extension of said retainer being installed within said slot and said inwardly concave curvature serving to resiliently urge said retainer against said peripheral edge of said transparent panel to secure said transparent panel within said frame.

14. The modular solarium construction of claim 13 wherein:

each said peripheral retainer is formed of ultra high density polyvinyl chloride material.

15. A modular solarium construction comprising:

(a) a plurality of prefabricated wall panels, each said prefabricated wall panel including:

(i) at least one transparent sheet of material having a peripheral edge, and (ii) a peripheral frame supporting said peripheral edge and positioned therearound, said peripheral frame having at least opposite outer surfaces with an opening in each said outer surface;

(b) a plurality of prefabricated ceiling panels, each said prefabricated ceiling panel including:

(i) at least one transparent sheet of material having a peripheral edge, (ii) a peripheral frame supporting said peripheral edge and positioned therearound, said peripheral frame having at least opposite outer surfaces with an opening in each said outer surface; and (c) a plurality of joint members for connecting together said prefabricated panels, each said joint member including:

(i) a joint frame member, and (ii) a plurality of protrusions extending from said joint frame member, each said protrusion having a free enlarged end for locking engagement within a respective said opening, wherein said panels are locked to each other by said joint members to form said modular solarium construction.

16. A modular solarium construction according to claim 15, wherein each said prefabricated wall panel includes a retainer for retaining said at least one transparent sheet of material in a respective said peripheral frame.

17. A modular solarium construction according to claim 16, wherein each said peripheral frame includes at least one retainer opening for receiving at least one said retainer such that said at least one retainer clamps a respective said transparent sheet of material against the respective said peripheral frame.

18. A modular solarium construction according to claim 17, wherein each said retainer has a generally triangular cross-sectional configuration having at least one extension at an apex thereof, with said at least one extension fitting within said at least one retainer opening to secure said retainer to the respective said peripheral frame.

19. A modular solarium construction according to claim 17, wherein:

each said peripheral frame has an L-shaped cross-sectional configuration comprising a first leg and a second leg at right angles to said first leg, said second leg defining a seat on which said transparent panel is positioned, and said first said leg having said at least one retainer opening therein for receiving said at least one retainer such that said at least one retainer clamps said respective transparent sheet of material against the second leg.

20. A modular solarium construction according to claim 15, wherein at least one said joint member has a generally U-shaped configuration, and includes two sets of said protrusions, said sets being arranged in spaced apart, substantially parallel relation and interconnected by said joint frame member.

21. A modular solarium construction according to claim 15, wherein at least one said joint frame member includes:

a central frame member, and two flanges extending away from each other at opposite sides of said central frame member, with said protrusions being formed on said flanges.

22. A modular solarium construction according to claim 21 wherein said central frame member has a U-shaped configuration with opposite free ends, and said flanges extend from said opposite free ends of said U-shaped central frame member.

23. A modular solarium construction according to claim wherein:

said central frame member includes two spaced apart walls which define a channel therebetween, and each said joint member includes a longitudinal reinforcement member captured within said channel.

24. A modular solarium construction according to claim 15 wherein each said joint member includes:

a first joint frame member having a plurality of said protrusions which engage within the openings in one outer surface of each of the adjacent frame members of adjacent said prefabricated wall panels, and a second joint frame member having a plurality of said protrusions which engage within the openings in the opposite outer surface of each of the adjacent frame members of said adjacent prefabricated wall panels.

25. A modular solarium construction according to claim 24, wherein each said joint member includes an insulation member surrounded by said first and second joint frame members and the adjacent frame members.

26. A modular solarium construction according to claim 15, wherein said joint members further include a cap which is secured to and covers said joint frame member.

27. A modular solarium construction according to claim 15, wherein each of said frame members includes a plurality of cavities therein.

28. A kit for forming a modular solarium construction, comprising:

(a) a plurality of prefabricated wall panels, each said prefabricated wall panel including:

(i) at least one transparent sheet of material having a peripheral edge, and (ii) a peripheral frame supporting said peripheral edge and positioned therearound, said peripheral frame having at least opposite outer surfaces with an opening in each said outer surface;

(b) a plurality of prefabricated ceiling panels, each said prefabricated ceiling panel including:

(i) at least one transparent sheet of material having a peripheral edge, (ii) a peripheral frame supporting said peripheral edge and positioned therearound, said peripheral frame having at least opposite outer surfaces with an opening in each said outer surface; and (c) a plurality of joint members for connecting together said prefabricated panels, each said joint member including:

(i) a joint frame member, and (ii) a plurality of protrusions extending from said joint frame member, each said protrusion having a free enlarged end for locking engagement within a respective said opening, wherein said panels are locked to each other by said joint members to form said modular solarium construction.

29. A kit for forming a modular solarium construction according to claim 28, wherein each said prefabricated wall panel includes a retainer for retaining said at least one transparent sheet of material in a respective said peripheral frame.

30. A kit for forming a modular solarium construction according to claim 29, wherein each said peripheral frame includes at least one retainer opening for receiving at least one said retainer such that said at least one retainer clamps a respective said transparent sheet of material against the respective said peripheral frame.

31. A kit for forming a modular solarium construction according to claim 30, wherein each said retainer has a generally triangular cross-sectional configuration having at least one extension at an apex thereof, with said at least one extension fitting within said at least one retainer opening to secure said retainer to the respective said peripheral frame.

32. A kit for forming a modular solarium construction according to claim 31, wherein:

each said peripheral frame has an L-shaped cross-sectional configuration comprising a first leg and a second leg at right angles to said first leg, said second leg defining a seat on which said transparent panel is positioned, and said first said leg having said at least one retainer opening therein for receiving said at least one retainer such that said at least one retainer clamps said respective transparent sheet of material against the second leg.

33. A kit for forming a modular solarium construction according to claim 28, wherein at least one said joint member has a generally U-shaped configuration, and includes two sets of said protrusions, said sets being arranged in spaced apart, substantially parallel relation and interconnected by said joint frame member.

34. A kit for forming a modular solarium construction according to claim 28, wherein at least one said joint frame member includes:

a central frame member, and two flanges extending away from each other at opposite sides of said central frame member, with said protrusions being formed on said flanges.

35. A kit for forming a modular solarium construction according to claim 34, wherein said central frame member has a U-shaped configuration with opposite free ends, and said flanges extend from said opposite free ends of said U-shaped central frame member.

36. A kit for forming a modular solarium construction according to claim 35, wherein:

said central frame member includes two spaced apart walls which define a channel therebetween, and each said joint member includes a longitudinal reinforcement member captured within said channel.

37. A kit for forming a modular solarium construction according to claim 28, wherein each said joint member includes:

a first joint frame member having a plurality of said protrusions which engage within the openings in one outer surface of each of the adjacent frame members of adjacent said prefabricated wall panels, and a second joint frame member having a plurality of said protrusions which engage within the openings in the opposite outer surface of each of the adjacent frame members of said adjacent prefabricated wall panels.

38. A kit for forming a modular solarium construction according to claim 37, wherein each said joint member includes an insulation member surrounded by said first and second joint frame members and the adjacent frame members.

39. A kit for forming a modular solarium construction according to claim 28, wherein said joint members further include a cap which is secured to and covers said joint frame member.

40. A kit for forming a modular solarium construction according to claim 28, wherein each of said frame members includes a plurality of cavities therein.

* * * * *